US006108827A

United States Patent [19]

Espadas

[11] Patent Number: 6,108,827

[45] Date of Patent: Aug. 29, 2000

[54] TOILET BOWL COVER

[76] Inventor: Octavio Espadas, 901 Brush St. #37, Las Vegas, Nev. 89107

[21] Appl. No.: 09/296,324

[22] Filed: Apr. 22, 1999

[51] Int. Cl.[7] ..... A47K 13/00

[52] U.S. Cl. ..... 4/253

[58] Field of Search ..... 4/253, 661

[56] References Cited

U.S. PATENT DOCUMENTS 1,793,815 2/1931 McCann ..... 4/253

5,560,049 10/1996 Robinson et al. ..... 4/253

5,581,824 12/1996 Crook, Sr. ..... 4/253

*Primary Examiner*—Robert M. Fetsuga

[57] ABSTRACT

A toilet bowl cover for covering a toilet bowl to prevent use of the toilet. The toilet bowl cover includes a top panel with a lower wall downwardly extending along a front edge of the top panel. A spaced apart pair of securing arms are extended from a pair of rear edges of the lower wall. Each of the securing arms has a hole therethrough adjacent a free end of the respective securing arm. An elongate rod is extended through the holes of the securing arms such that the rod extends between the securing arms.

9 Claims, 2 Drawing Sheets

TOILET BOWL COVER

BACKGROUND OF THE INVENTION

1. Field of the Invention

The present invention relates to toilet bowl covers and more particularly pertains to a new toilet bowl cover for covering a toilet bowl to prevent use of the toilet.

2. Description of the Prior Art

The use of toilet bowl covers is known in the prior art. More specifically, toilet bowl covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,003,641 by Selman, Jr.; U.S. Pat. No. 2,996,731 by Leptrone; U.S. Pat. No. 4,651,358 by Logan, Jr.; U.S. Pat. No. 4,524,470 by Grenell; U.S. Pat. No. Des. 352,102 by Barnette et al.; and U.S. Pat. No. 2,698,439 by Bruckner.

While these devices fulfill their respective, particular objectives and requirements, the aforementioned patents do not disclose a new toilet bowl cover. The inventive device includes a top panel with a lower wall downwardly extending along a front edge of the top panel. A spaced apart pair of securing arms are extended from a pair of rear edges of the lower wall. Each of the securing arms has a hole therethrough adjacent a free end of the respective securing arm. An elongate rod is extended through the holes of the securing arms such that the rod extends between the securing arms.

In these respects, the toilet bowl cover according to the present invention substantially departs from the conventional concepts and designs of the prior art, and in so doing provides an apparatus primarily developed for the purpose of covering a toilet bowl to prevent use of the toilet.

SUMMARY OF THE INVENTION

In view of the foregoing disadvantages inherent in the known types of toilet bowl covers now present in the prior art, the present invention provides a new toilet bowl cover construction wherein the same can be utilized for covering a toilet bowl to prevent use of the toilet.

The general purpose of the present invention, which will be described subsequently in greater detail, is to provide a new toilet bowl cover apparatus and method which has many of the advantages of the toilet bowl covers mentioned heretofore and many novel features that result in a new toilet bowl cover which is not anticipated, rendered obvious, suggested, or even implied by any of the prior art toilet bowl covers, either alone or in any combination thereof.

To attain this, the present invention generally comprises a top panel with a lower wall downwardly extending along a front edge of the top panel. A spaced apart pair of securing arms are extended from a pair of rear edges of the lower wall. Each of the securing arms has a hole therethrough adjacent a free end of the respective securing arm. An elongate rod is extended through the holes of the securing arms such that the rod extends between the securing arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet bowl cover apparatus and method which has many of the advantages of the toilet bowl covers mentioned heretofore and many novel features that result in a new toilet bowl cover which is not anticipated, rendered obvious, suggested, or even implied by any of the prior art toilet bowl covers, either alone or in any combination thereof.

It is another object of the present invention to provide a new toilet bowl cover which may be easily and efficiently manufactured and marketed.

It is a further object of the present invention to provide a new toilet bowl cover which is of a durable and reliable construction.

An even further object of the present invention is to provide a new toilet bowl cover which is susceptible of a low cost of manufacture with regard to both materials and labor, and which accordingly is then susceptible of low prices of sale to the consuming public, thereby making such toilet bowl cover economically available to the buying public.

Still yet another object of the present invention is to provide a new toilet bowl cover which provides in the apparatuses and methods of the prior art some of the advantages thereof, while simultaneously overcoming some of the disadvantages normally associated therewith.

Still another object of the present invention is to provide a new toilet bowl cover for covering a toilet bowl to prevent use of the toilet.

Yet another object of the present invention is to provide a new toilet bowl cover which includes a top panel with a lower wall downwardly extending along a front edge of the top panel. A spaced apart pair of securing arms are extended from a pair of rear edges of the lower wall. Each of the securing arms has a hole therethrough adjacent a free end of the respective securing arm. An elongate rod is extended through the holes of the securing arms such that the rod extends between the securing arms.

Still yet another object of the present invention is to provide a new toilet bowl cover that may be used to cover a toilet bowl to prevent use of a not-in-service toilet or a newly installed toilet at a construction site.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
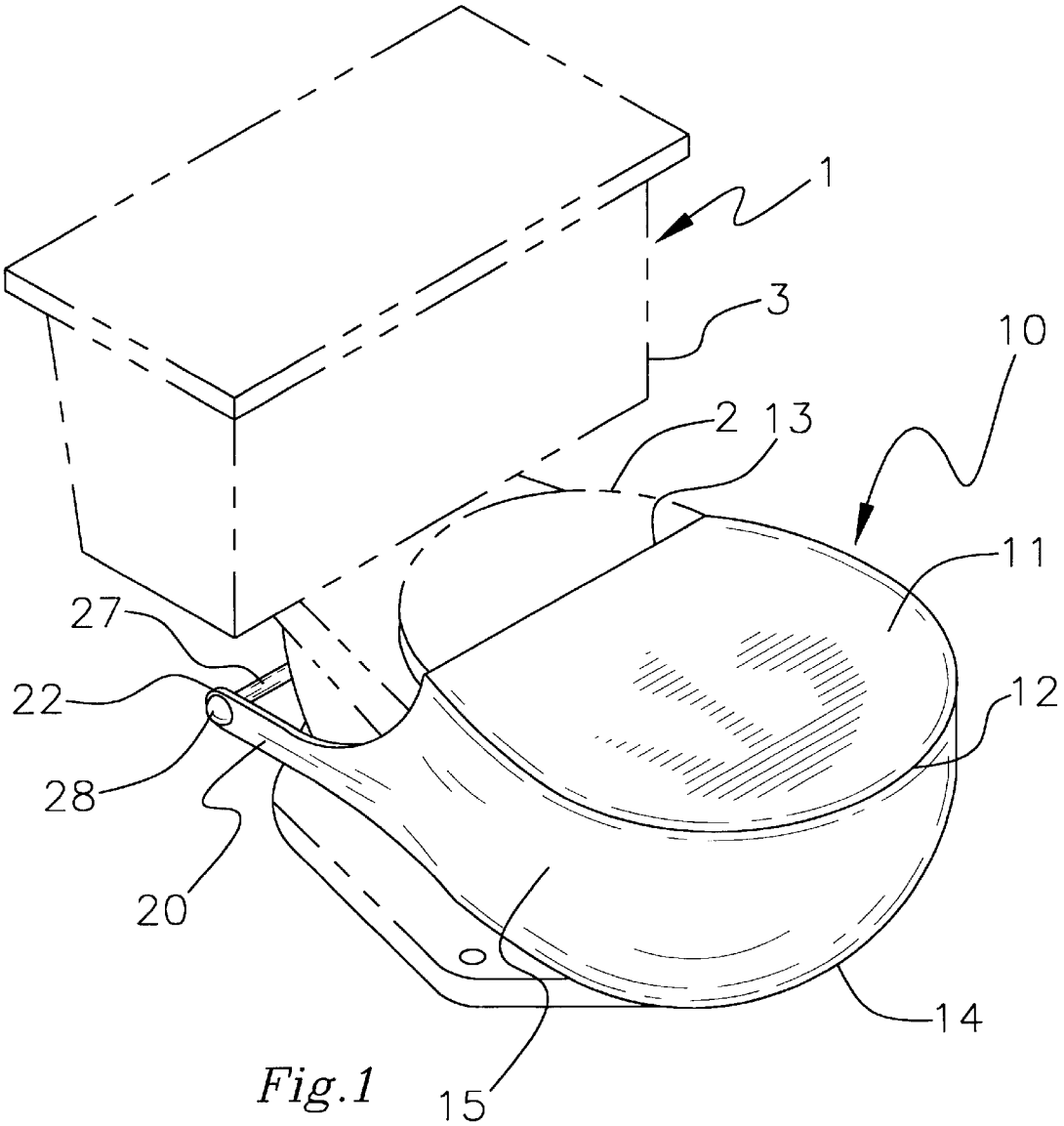
FIG. 1 is a schematic perspective view of a new toilet bowl cover in use according to the present invention covering the top opening of a toilet bowl.

With reference now to the drawings, and in particular to FIGS. 1 through 4 thereof, a new toilet bowl cover embodying the principles and concepts of the present invention and generally designated by the reference numeral 10 will be described.

As best illustrated in FIGS. 1 through 4, the toilet bowl cover 10 generally comprises a top panel with a lower wall downwardly extending along a front edge of the top panel. A spaced apart pair of securing arms are extended from a pair of rear edges of the lower wall. Each of the securing arms has a hole therethrough adjacent a free end of the respective securing arm. An elongate rod is extended through the holes of the securing arms such that the rod extends between the securing arms.

In use, the cover 10 is designed for use with a toilet 1 having a toilet bowl 2 and a toilet tank 3. The toilet bowl has a top opening, and front and rear portions. The toilet tank is positioned above the rear portion of the toilet bowl. Specifically, the cover 10 includes a top panel 11 having a generally semi-circular outer perimeter comprising an arcuate front edge 12 and a substantially straight back edge 13. In use, the top panel is designed for resting on a toilet bowl to cover a portion of a top opening of the toilet bowl such that the front edge of the top panel is positioned towards a front portion of the toilet bowl and the back edge of the top panel is positioned towards a back portion of the toilet bowl.

A generally U-shaped lower wall 14 downwardly depends from the top panel along the front edge of the top panel. The lower wall has a spaced apart pair of side portions 15,16 and an arcuate forwards portion 17 connecting the side portions of the lower wall together. In use, the lower wall is designed for extending along the front portion of the toilet bowl as illustrated in FIG. 1. The lower wall has a lower edge extending along the forwards and side portions of the lower wall. Additionally, the side portions of the lower wall each have a rear edge located towards the back edge of the top panel.

Figure 4:
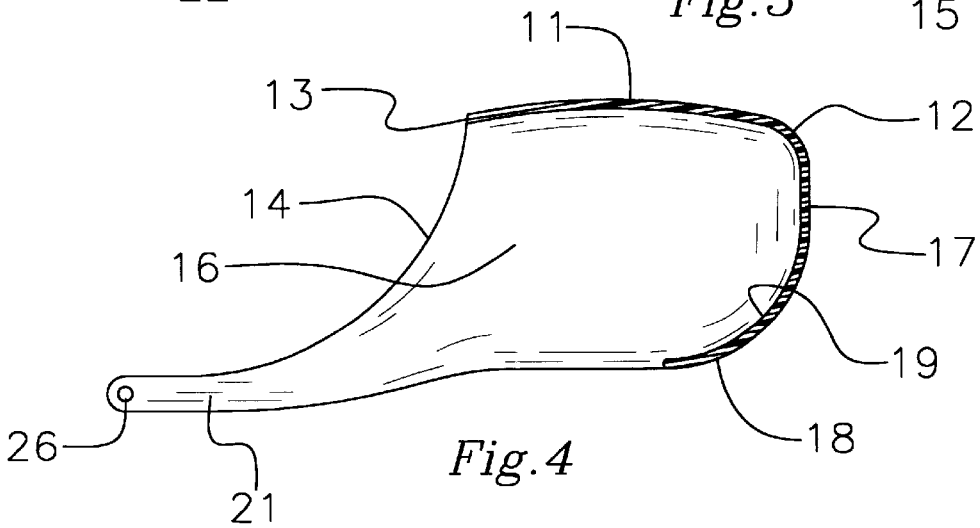
FIG. 4 is a schematic cross sectional view of the present invention taken from line 4—4 of FIG. 2.

With reference to FIG. 4, the forwards portion of the lower wall has an arcuate lower region 18 adjacent the lower edge of the lower wall. The lower region of the forwards portion of the lower wall curves in a direction towards the rear edges of the side portions of the lower wall such that the lower region has a concave inner face 19 facing in a direction towards the back edge of the top panel. In use, the lower region of the forwards portion of the lower wall is designed for positioning beneath the front portion of the toilet bowl such that the front portion of the toilet bowl is positioned between the top panel and the lower region of the forwards portion of the lower wall. This prevents direct lifting of the top panel off of the top opening of the toilet bowl. Preferably, the lower region extends more than about one-eighth and less than about one-half of the length of the top panel to help ensure the securing of the cover over the front portion of the toilet bowl.

Figure 2:
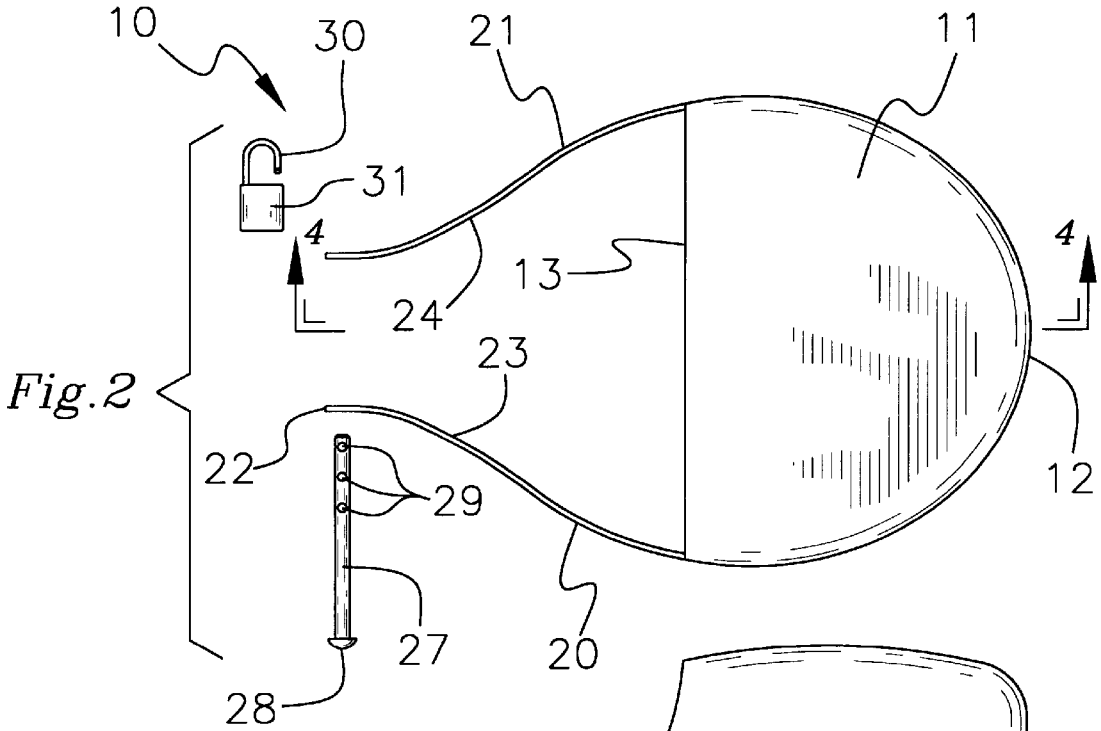
FIG. 2 is a schematic top side view elements of the present invention separated from one another.
Figure 3:
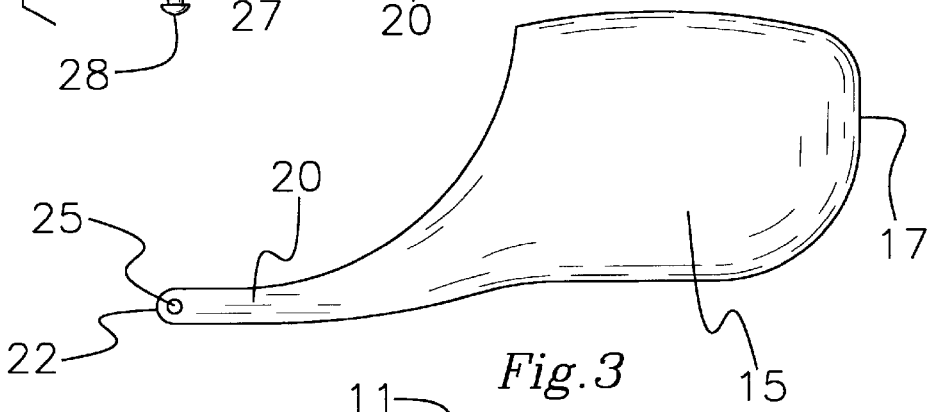
FIG. 3 is a schematic side view of the present invention.

As illustrated in FIG. 2, the rear edges of the side portions of the lower wall each have a resilient securing arm 20,21 extending therefrom in a direction away from the forwards portion of the lower wall. Each of the securing arms has a free end 22 distal the forwards portion of the lower wall. As illustrated in FIG. 1, in use, the securing arms are designed for positioning adjacent a rear portion of the toilet bowl such that the free ends of the securing arms are positioned beneath a toilet tank positioned above the rear portion of the toilet bowl. In use, the securing arms may be pushed towards each other or pulled apart to fit the rear portion of the particular toilet bowl is covered.

The securing arms define a width therebetween. Preferably, each of the securing arms has a curved portion 23,24 converging towards each other. The curved portion of each securing arm is positioned between the rear edge of the associated side portion of the lower wall and the free end of the respective securing arm. The curving portions make the width between the securing arms adjacent the free ends of the securing arms is less than the width of the securing arms adjacent the rear edges of the side portions of the lower wall. Ideally, the width between the securing arms adjacent the free ends of the securing arms is less than about three-fourths and ideally about one-third the width of the securing arms adjacent the rear edges of the side portions of the lower wall.

Each of the securing arms has a generally circular hole 25,26 therethrough adjacent the free end of the respective securing arm. Preferably, the holes of the securing arms are generally coaxial with one another. In use, the axis of the holes of the securing arms is designed for extending behind the rear portion of the toilet bowl beneath the toilet tank.

An elongate rod 27 is extended through the holes of the securing arms such that the rod extends between the securing arms. The rod has a pair of opposite ends. A first of the ends of the rod is outwardly extended through the hole of one of the securing arms and a second of the ends of the rod is outwardly extended through the hole of another of the securing arms. In use, the rod is designed for preventing the removal of the cover off of the toilet bowl by preventing the top panel from is slid forwards or upwards off of the top opening of the toilet bowl. The first end of the rod has a head portion 28 bounding an area greater than an area bounded by the hole of the associated securing arm. In other words, the diameter of the head portion is greater than the diameter of the hole of the associated securing arm. This relationship prevents sliding of the associated adjacent securing arm off of the first end of the rod. As illustrated in FIG. 2, the rod has also a row of spaced apart bores 29 therethrough adjacent the second end of the rod. In use, at least one of the bores of the rod is positioned adjacent an outer side of the associated securing arm. A locking bolt 30 of a lock 31 is extended through the bore of the rod located adjacent the outer side of the associated securing arm to prevent sliding of the associated adjacent securing arm off of the second end of the rod until the lock is removed from the rod.

In an ideal illustrative embodiment, the cover has a maximum width between the side portions of the lower wall of about 16 inches, a maximum length between the free ends of the securing arms and the front portion of the lower wall of about 24 inches, and a height defined between the top panel and the lower edge of the lower wall of about 9 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cover for covering a toilet bowl, comprising:

a top panel having an arcuate front edge and a substantially straight back edge;

a lower wall downwardly extending from said top panel along said front edge of said top panel;

said lower wall having a spaced apart pair of side portions and a forwards portion connecting said side portions of said lower wall together;

said lower wall having a lower edge extending along said forwards and side portions of said lower wall;

said side portions of said lower wall each having a rear edge located towards said back edge of said top panel;

said rear edges of said side portions of said lower wall each having a resilient securing arm extending therefrom in a direction away from said forwards portion of said lower wall;

each of said securing arms having a free end;

each of said securing arms having a hole therethrough adjacent said free end of the respective securing arm; and an elongate rod being extended through said holes of said securing arms such that said rod extends between said securing arms.

2. The cover of claim 1, wherein said forwards portion of said lower wall has an arcuate lower region adjacent said lower edge of said lower wall, said lower region of said forwards portion of said lower wall curving in a direction towards said rear edges of said side portions of said lower wall such that said lower region has a concave inner face facing in a direction towards said back edge of said top panel.

3. The cover of claim 1, wherein each of said securing arms has a curved portion converging towards each other, said curved portion of each securing arm being positioned between said rear edge of the associated side portion of said lower wall and said free end of the respective securing arm.

4. The cover of claim 3, wherein said securing arms define a width therebetween, said width between said securing arms adjacent said free ends of said securing arms being less than said width of said securing arms adjacent said rear edges of said side portions of said lower wall.

5. The cover of claim 1, wherein said holes of said securing arms are generally coaxial with one another.

6. The cover of claim 1, wherein said rod has a pair of opposite ends, a first of said ends of said rod being outwardly extended through said hole of one of said securing arms, and a second of said ends of said rod being outwardly extended through said hole of another of said securing arms.

7. The cover of claim 6, wherein said first end of said rod having a head portion bounding an area greater than an area bounded by said hole of the associated securing arm to prevent sliding of the associated adjacent securing arm off of said first end of said rod.

8. The cover of claim 6, wherein said rod has a bore therethrough adjacent said second end of said rod, said bore of said rod being positioned adjacent an outer side of the associated securing arm, wherein a lock is provided having a locking bolt, said locking bolt of said lock being extended through said bore of said rod to prevent sliding of the associated adjacent securing arm off of said second end of said rod.

9. A cover for covering a toilet bowl, comprising:

a toilet having a toilet bowl and a toilet tank, said toilet bowl having a top opening, and front and rear portion, said toilet tank being positioned above said rear portion of said toilet bowl;

a top panel having a generally semi-circular outer perimeter comprising an arcuate front edge and a substantially straight back edge;

said top panel being adapted for resting on a toilet bowl to cover a portion of a top opening of the toilet bowl such that said front edge of said top panel is positioned towards a front portion of the toilet bowl and said back edge of said top panel is positioned towards a back portion of the toilet bowl;

a generally U-shaped lower wall downwardly extending from said top panel along said front edge of said top panel;

said lower wall having a spaced apart pair of side portions and an arcuate forwards portion connecting said side portions of said lower wall together;

said lower wall being adapted for extending along the front portion of the toilet bowl;

said lower wall having a lower edge extending along said forwards and side portions of said lower wall;

said side portions of said lower wall each having a rear edge located towards said back edge of said top panel;

said forwards portion of said lower wall having an arcuate lower region adjacent said lower edge of said lower wall, said lower region of said forwards portion of said lower wall curving in a direction towards said rear edges of said side portions of said lower wall such that said lower region has a concave inner face facing in a direction towards said back edge of said top panel;

said lower region of said forwards portion of said lower wall being adapted for positioning beneath the front portion of the toilet bowl such that the front portion of the toilet bowl is positioned between the top panel and the lower region of said forwards portion of said lower wall;

said rear edges of said side portions of said lower wall each having a resilient securing arm extending therefrom in a direction away from said forwards portion of said lower wall;

each of said securing arms having a free end;

said securing arms being adapted for positioning adjacent a rear portion of the toilet bowl such that said free ends of said securing arms are positioned beneath a toilet tank positioned above the rear portion of the toilet bowl;

each of said securing arms having a curved portion converging towards each other, said curved portion of each securing arm being positioned between said rear edge of the associated side portion of said lower wall and said free end of the respective securing arm;

said securing arms defining a width therebetween, said width between said securing arms adjacent said free ends of said securing arms being less than said width of said securing arms adjacent said rear edges of said side portions of said lower wall;

each of said securing arms having a generally circular hole therethrough adjacent said free end of the respective securing arm;

said holes of said securing arms being generally coaxial with one another, the axis of said holes of said securing arms being adapted for extending behind the rear portion of the toilet bowl beneath the toilet tank;

an elongate rod being extended through said holes of said securing arms such that said rod extends between said securing arms, said rod having a pair of opposite ends, a first of said ends of said rod being outwardly extended through said hole of one of said securing arms, a second of said ends of said rod being outwardly extended through said hole of another of said securing arms;

said first end of said rod having a head portion bounding an area greater than an area bounded by said hole of the associated securing arm to prevent sliding of the associated adjacent securing arm off of said first end of said rod;

said rod having a row of spaced apart bores therethrough adjacent said second end of said rod, at least one of said bores of said rod being positioned adjacent an outer side of the associated securing arm; and a lock having a locking bolt, said locking bolt of said lock being extended through said bore of said rod located adjacent said outer side of the associated securing arm to prevent sliding of the associated adjacent securing arm off of said second end of said rod.

* * * * *